US007793374B1

(12) United States Patent
Anderson et al.

(10) Patent No.: US 7,793,374 B1
(45) Date of Patent: Sep. 14, 2010

(54) ADJUSTABLE HEIGHT BRIDGING RAMP SYSTEM

(75) Inventors: Robert W. Anderson, Alexandria, VA (US); Sean M. Gallagher, Philadelphia, PA (US); Kellie L. Redcay, Pottstown, PA (US); Ryan T. Hayleck, Fulton, MD (US); John F. O'Dea, Laurel, MD (US); Stuart G. Ullman, Kensington, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 640 days.

(21) Appl. No.: 11/788,422

(22) Filed: Apr. 20, 2007

Related U.S. Application Data

(60) Provisional application No. 60/797,085, filed on Apr. 21, 2006.

(51) Int. Cl.
*B63B 17/00* (2006.01)

(52) U.S. Cl. ..... 14/69.5; 114/362

(58) Field of Classification Search ..... 404/69.5–73; 114/362

See application file for complete search history.

(56) References Cited

U.S. PATENT DOCUMENTS

| | | | | |
|---|---|---|---|---|
| 2,340,764 | A | 2/1944 | Makaroff | |
| 2,875,457 | A * | 3/1959 | Read et al. | 14/71.5 |
| 3,604,532 | A * | 9/1971 | Moore | 182/93 |
| 3,674,240 | A | 7/1972 | Larsson | |
| 3,825,244 | A | 7/1974 | Bauer | |
| 4,147,123 | A | 4/1979 | Kirby et al. | |
| 4,441,449 | A | 4/1984 | Biaggi | |
| 4,960,203 | A | 10/1990 | Kalazny | |
| 5,084,936 | A * | 2/1992 | Thomas, Jr. | 14/71.5 |
| 5,140,924 | A * | 8/1992 | Dixon | 114/61.14 |
| 5,950,266 | A * | 9/1999 | Streeter et al. | 14/69.5 |

(Continued)

OTHER PUBLICATIONS

U.S. Appl. No. 60/797,085, filed Apr. 21, 2006, entitled "Cargo Transfer Method and Apparatus," joint inventors Robert W. Anderson, Stuart G. Ullman, Kellie L Redcay, Ryan T. Hayleck, John F. O'Dea, Sean M. Gallagher, Christopher J. Doyle, and Donald R. Jacobsen.

(Continued)

*Primary Examiner*—Raymond W Addie
(74) *Attorney, Agent, or Firm*—Howard Kaiser

(57) ABSTRACT

As typically embodied, the inventive ramp system for bridging between structures (e.g., marine vessels) includes a hydraulic elevator device and a ramp unit. The ramp unit includes three adjoining planar members, the ramp member (the main ramp body) being pivotably connected at each end to one of the two platform members. The hydraulic elevator device includes the coaxial combination of a cylinder and a piston, the piston being translatable along and pivotable about the axis. The cylinder-piston combination is secured, axis vertical, to a first structure, with one of the ramp unit's platform members attached atop the piston. In order to position the other (unattached) platform member upon a selected (e.g., horizontal) location of a second structure, the ramp unit is configurable in terms of the attached platform member's height, the ramp unit's horizontal rotation angle, and the respective vertical rotation angles of the ramp unit's two pivotable connections.

12 Claims, 7 Drawing Sheets

U.S. PATENT DOCUMENTS

| | | | | |
|---|---|---|---|---|
| 6,192,541 | B1 | 2/2001 | Castelli et al. | |
| 6,536,363 | B1 | 3/2003 | Carlberg | |
| 6,811,368 | B1 | 11/2004 | Blank et al. | |
| 6,851,149 | B2 | 2/2005 | King, Jr. | |
| 6,923,140 | B1 * | 8/2005 | Cook | 114/362 |
| 2005/0019127 | A1 | 1/2005 | Sain | |
| 2005/0019128 | A1 | 1/2005 | Sain | |
| 2005/0220543 | A1 | 10/2005 | Sain | |

OTHER PUBLICATIONS

U.S. Appl. No. 11/789,116, filed Apr. 20, 2007, entitled "Vertical Damper for Ship-to-Ship Mooring," joint inventors John F. O'Dea, Robert W. Anderson, Sean M. Gallagher, Ryan T. Hayleck, Kellie L. Redcay, and Stuart G. Ullman.

U.S. Appl. No. 11/789,125, filed Apr. 20, 2007, entitled "LCAC Carrier and Flow-Through Ship," joint inventors Robert W. Anderson, Stuart Ullman, Kellie Redcay, Ryan Hayleck, John O'Dea, Sean Gallagher, Chris Doyle, and Donald R. Jacobsen.

* cited by examiner 10 ft
a

ELEVATOR DEVICE 20
PISTON 24
20 ft
CYLINDER 22
HYDRAULIC FLUID 23
VALVE 28
27
CONTROL SYSTEM 29
TANK 25
PUMP 26

ADJUSTABLE HEIGHT BRIDGING RAMP SYSTEM

CROSS-REFERENCE TO RELATED APPLICATIONS

This application claims the benefit of U.S. provisional patent application No. 60/797,085, filing date 21 Apr. 2006, hereby incorporated herein by reference, entitled "Cargo Transfer Method and Apparatus," joint inventors Robert W. Anderson, Stuart G. Ullman, Kellie L Redcay, Ryan T. Hayleck, John F. O'Dea, Sean M. Gallagher, Christopher J. Doyle, and Donald R. Jacobsen.

This application is related to U.S. nonprovisional patent application Ser. No. 11/527,666, filing date 18 Sep. 2006, now U.S. Pat. No. 7,556,471 B1, issuance date 7 Jul. 2009, hereby incorporated herein by reference, entitled "Inter-Ship Personnel Transfer Device and Method of Moving between Compacted State and Non-Compacted State," joint inventors Sean M. Gallagher, Stuart G. Ullman, Ryan T. Hayleck, Christopher J. Doyle, John F. O'Dea, Robert W. Anderson, and Kellie L. Redcay.

This application is related to U.S. nonprovisional patent application Ser. No. 11/789,116, filing date 20 Apr. 2007, now U.S. Pat. No. 7,516,712 B1, issuance date 14 Apr. 2009, hereby incorporated herein by reference, entitled "Vertical Damper for Mooring Vessels," joint inventors John F. O'Dea, Robert W. Anderson, Sean M. Gallagher, Ryan T. Hayleck, Kellie L. Redcay, and Stuart G. Ullman.

This application is related to the U.S. nonprovisional patent application Ser. No. 11/789,125, filing date 20 Apr. 2007, now U.S. Pat. No. 7,621,230 B1, issuance date 24 Nov. 2009, hereby incorporated herein by reference, entitled "Carrier and Flow-Through Ship," joint inventors Robert W. Anderson, Stuart Ullman, Kellie Redcay, Ryan Hayleck, John O'Dea, Sean Gallagher, Chris Doyle, and Donald R. Jacobsen.

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to cargo transfer, more particularly to cargo transfer involving marine vessels at sea.

A Landing Craft Air Cushion (LCAC) is a high-speed air-cushion hovercraft. The LCAC is typically used by the U.S. Navy as an amphibious landing craft for carrying weapons, equipment, cargo and personnel from a ship (e.g., an amphibious assault ship) to the shore, and for returning to the ship for another load. Current U.S. Navy Sea Base plans call for a capability to launch and support the operations of a Marine Expeditionary Brigade (MEB) from the ships of the Sea Base. The LCAC is the primary surface assault connector. The LCAC has the ability to climb and descend slopes; however, the U.S. Navy's need to fully exploit these climbing/descending capabilities did not arise until presently, as the LCAC is the prime surface assault connector of the Sea Base.

Unfortunately, there is no existing asset to bring the necessary number of required LCACs into theater. Another problem is how to load these LCACs to support the MEB in an efficient and timely manner. Current methods of loading LCACs from larger cargo ships at sea involve loading LCACs while they are in the water, or driving them onto lightweight temporary platforms that are relatively small in size and hence subject to substantial motion as sea states rise. It simply takes too much time to load each LCAC using current methods. Alternative approaches have been suggested that would use a ship as both an LCAC carrier and a transfer enabler for the Sea Base. Some of these concepts require the ship to ballast-down, as in a heavy lift ship, so that the LCACs can fly on and off the mother ship. Other concepts use large elevators to transfer the LCAC between the carrier and the water. These concepts are complex and create a critical failure path.

It is also desirable for two or more ships to have the capability to moor together while at sea. However, the forces creating the relative vertical motions between two or more ships are too powerful to be overcome by traditional mooring and tendering systems. To fight these forces would mean fighting the entire restorative buoyancy force. Aside from welding the ships together (certainly a preposterous solution), this is virtually unachievable. Analysis shows that in Sea State 4, the upper requirement for Sea Base operations, the relative vertical movement between two ships moored together will be too great to allow the safe transfer of personnel and cargo.

Of particular interest herein is the capability to transfer cargo and personnel between two different marine vessels at sea. For the onloading and offloading of cargo, traditional "Roll-On/Roll-Off" (RO/RO) ramps operate through the bow or stern of a ship, and in association with a pier. According to this conventional practice of cargo transfer between a ship and a pier, the height of the pier is known either as a specific value or as falling within a specific range of values. In contrast, for ships at sea, it would be extremely difficult to moor two or more ships bow to stern so that an RO/RO procedure could occur. Nevertheless, in certain U.S. Naval evolutions (such as involving cargo/personnel transfer a Sea Base), a large number of vehicles must be transferred from one ship to another. While a crane could be used to move these vehicles, an RO/RO operation would be much more efficient insofar as the vehicles would, in effect, be moving themselves between the ships. The RO/RO concept in general principle is advantageous in that it avails itself of the inherent ability of transportation vehicles to move from one place to another.

Since it is impracticable that ships at sea moor bow-to-stern, the possibility suggests itself that some sort of RO/RO methodology be performed transversely between two ships at sea that are moored "skin-to-skin." However, this introduces another problem in that the freeboard between ships can vary quite a bit, and ships with side-ports offer an even lower access point. It has been believed to be impossible to develop a multi-purpose ramp system (i.e., a ramp system that is not ship-specific) that could accommodate the wide range of potential vertical heights of the various ships that may require transfer, on and/or off, of vehicles and/or personnel.

SUMMARY OF THE INVENTION

In view of the foregoing, it is a principal object of the present invention to provide methodologies that afford improved capabilities for transferring cargo and personnel between marine vessels at sea.

In the instant disclosure it is especially an object of the present invention to provide a practical and efficient methodology for effecting RO/RO transfer of cargo between marine vessels at sea.

Disclosed herein, and in the two aforementioned nonprovisional patent applications being concurrently filed herewith, are various inventive methodologies that lend themselves to being practiced, either individually or in various combinations, toward the overall inventive goal of enhancing and expanding capabilities for transferring cargo between vessels at sea.

A first implementation of the present invention is emphasized by the aforementioned nonprovisional patent application entitled "LCAC Carrier and Flow-Through Ship." According to typical embodiments of this inventive implementation, a ship includes a forward ramp and an aft ramp. The inventive configuration allows LCACs to drive themselves on and off the ship. The inventive ship thus effectuates a variation on the theme of the RO/RO concept that is traditionally for wheeled traffic; however, as typically practiced, the inventive ship's traffic are hovercraft (e.g., LCACs). The inventive ship can carry the LCACs into the theater where they are needed, load them for a mission, launch them out via the forward ramp (and bow door), then retrieve them through the stern ramp (and stern door). The inventive ship does not require a well deck, ballast-down capability, or elevators to accommodate the LCACs. The inventive ship is designed to take advantage of the capability of an LCAC to climb and descend slight slopes. When LCAC operations are not underway, the inventive ship's bow and stern doors close to prevent seawater from flowing up the corresponding ramps and onto the inventive ship's LCAC deck.

A second implementation of the present invention is emphasized by the aforementioned nonprovisional patent application entitled "Vertical Damper for Ship-to-Ship Mooring." According to typical embodiments of this inventive implementation, a shock absorber device is useful for mooring ships together at sea. More specifically, the inventive shock absorber device is intended as a vertical damper to be used between ships that are moored together in an open seaway. By acting as a vertical damper between two ships, the inventive shock absorber device makes it possible to greatly reduce the relative vertical motions between the two moored ships, thereby permitting the safe transfer of cargo, personnel, and vehicles to proceed.

A third implementation of the present invention is emphasized by the instant nonprovisional patent application. According to typical embodiments of the inventive implementation instantly disclosed, a ramp system enables transfer of cargo and/or personnel between ships, permitting RO/RO (e.g., vehicular) traffic and/or personnel traffic. The inventive ramp system, as typically embodied, comprises a ramp apparatus and a hydraulic elevator device. Featured by the inventive ramp system is its adjustable height capability afforded by the hydraulic elevator device (including a hollow cylinder and a piston), which raises or lowers the entire ramp apparatus. The ramp apparatus can be raised or lowered in its entirety in order to interface with a wide variety of ships characterized by any in a wide range of Weather Deck freeboard values. This flexibility of use is much greater than traditionally thought possible for a ramp system.

The present invention's adjustable height bridging ramp system can be propitiously employed to transfer vehicles and/or cargo and/or personnel between ships at sea. The host ship (i.e., the ship on which the inventive ramp system is based) can perform at-sea RO/RO transfer, to and/or fro, with multifarious ships of wide-ranging descriptions and dimensions. The length, width, and height of the present invention's adjustable height bridging ramp system can be varied as design considerations in accordance with particular applications, for instance to accommodate the guest ship (i.e., the ship with which the host ship is interfacing) and/or the traffic (e.g., human or vehicular) or cargo that is contemplated. While the inventive ramping system is especially useful for at-sea RO/RO transfer, it can also be used with great benefit as a pier interface.

An important inventive design consideration is the nature of the vehicular and/or pedestrian traffic that is contemplated for crossing the inventive system's ramp apparatus. A useful motto here is to "know your traffic." For instance, if vehicles (e.g., wheeled motorized land vehicles such as HUMVEEs®) are to cross (e.g., drive across) the ramp apparatus, the inventive practitioner should consider the type(s) of vehicle(s) as well as the number of vehicles (and, if more than one type, the relative numbers of each type of vehicle). Of particular note are the weights of the vehicles because, in general, the structural weight of the ramp apparatus will be designed to be increased to accommodate the expected heavier loads. Inventive applications involving increasingly heavy vehicular weight and concomitant increasingly heavy ramp apparatus weight become increasingly difficult to practice in a moving sea way as torsion is increasingly factored into the equation. That the inventive ramp system's ramp apparatus, in typical operation, is oriented transversely with respect to the two ships may serve to reduce or eliminate excessive torsion on the ramp apparatus, due to lack or near lack of longitudinal vector in its orientation.

Many embodiments of the inventive ramp system are preferably practiced in combination with the inventive shock absorber device, which reduces or minimizes the amount of relative vertical movement between the host ship and the guest ship. The inventive shock absorber significantly decreases the relative motion, due to rolling, between the two side-by-side ships, thus bringing about significantly more favorable circumstances for the inventive ramp system's effectuation of RO/RO in a transverse mode. As a general rule, practice of the inventive ramp system between ships at sea under sea state conditions greater than two would probably be excessively hazardous in the absence of practice, combined therewith, of the inventive vertical damper device; when combined with the inventive vertical damper device, the inventive ramp system can safely be implemented up to sea states of four.

The inventive ramp system's ramp apparatus, as typically embodied, includes a host-end platform, a guest-end platform, a ramp (intermediate the host-end platform and the guest-end platform), a host-end hinge mechanism (joining the host-end platform and the ramp), and a guest-end hinge mechanism (joining the guest-end platform and the ramp). The present invention's hydraulic elevator device, typically situated on the host ship for the inventive ramp system, includes a large-diameter hollow cylinder and, snugly but slidably fitting therein, a slightly smaller diameter piston cylinder. As the present invention is typically practiced, the piston cylinder is both longitudinally-axially movable and rotatably movable, relative to the hollow cylinder. The piston cylinder has a sufficiently large diameter to accommodate the host end platform, which must be supported by the piston cylinder without any question as to structural integrity; according to typical inventive practice, the diameter of the piston cylinder equals or nearly equals the width of the host-end platform.

The determination of whether an inventive bridging ramp system that is installed on a host ship operates from a lower position or a higher position can be based on the characteristics of the guest ship (i.e., the non-host ship). If the guest ship has a low freeboard or is using a side-port access, then the hydraulic elevator is set at a lower piston position; if, on the other hand, the guest ship has a high freeboard or is using its weather deck (e.g., a deck house on the weather deck), then the hydraulic elevator is set at a higher piston position. The length of the piston cylinder is typically selected as a function of the vertical height expected to be needed for the operating stroke of the piston cylinder. In typical operation of the inventive ramp system, the vertical angle of the ramp is a function of the relative heights above the waterline of the top piston cylinder surface (where the host-end platform sits) and the guest ship's deck surface where the guest-end platform sits. In fact, each of these heights above the waterline can vary for the corresponding individual ship because of changes in displacement by that ship. Typical embodiments of the inventive ramp system can accommodate a wide range of above-waterline heights for the ramp apparatus's footing (i.e., the surface of the guest ship upon which the guest-end platform sits).

According to typical inventive practice, the inventive ramp system's guest-end platform is caused to be situated adjacent to, and at the same horizontal level (height) as, the structure with respect to which the inventive ramp system is being deployed. For instance, if the guest-end platform is considered for placement adjacent to a helicopter hangar, typically twenty feet in height, the piston cylinder should be configured to have a twenty-foot vertical run. When the piston cylinder is in a lower (e.g., its lowest) position, the guest-end platform can interface with the flight deck. When the piston cylinder is extended twenty feet upward to an upper (e.g., its highest) position, the guest-end platform can interface with the overhead (roof) of the helicopter hangar. The host ship can have onboard plural inventive bridging ramp systems in place; for instance, two inventive ramp systems, one starboard and the other port, can be installed on opposite sides of the host ship. One or more non-inventive ramps can be used in association with one or more inventive ramp systems. For instance, a secondary ramp angled downward from the hangar overhead to the flight deck can be used to move cargo (e.g., vehicles or personnel) between these two levels aboard the host ship; a conventional ramp can be utilized as this secondary ramp because there is no relative motion between the two levels of the same ship structure.

Other objects, advantages and features of the present invention will become apparent from the following detailed description of the present invention when considered in conjunction with the accompanying drawings.

BRIEF DESCRIPTION OF THE DRAWINGS

The present invention will now be described, by way of example, with reference to the accompanying drawings, wherein.

DETAILED DESCRIPTION OF THE INVENTION

Figure 1:
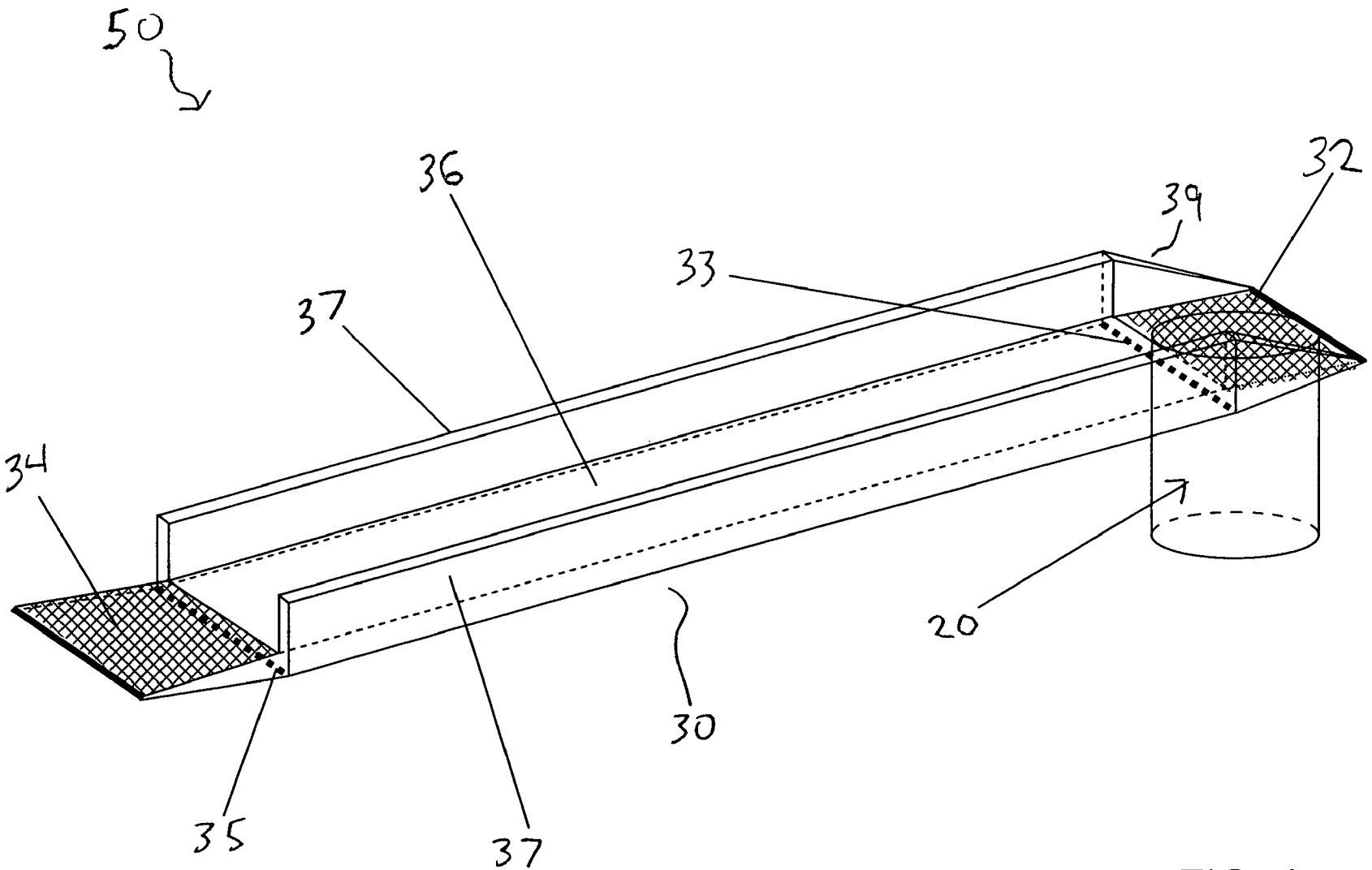
FIG. 1 is a perspective view of an embodiment of a bridging ramp system in accordance with the present invention.
Figure 2:
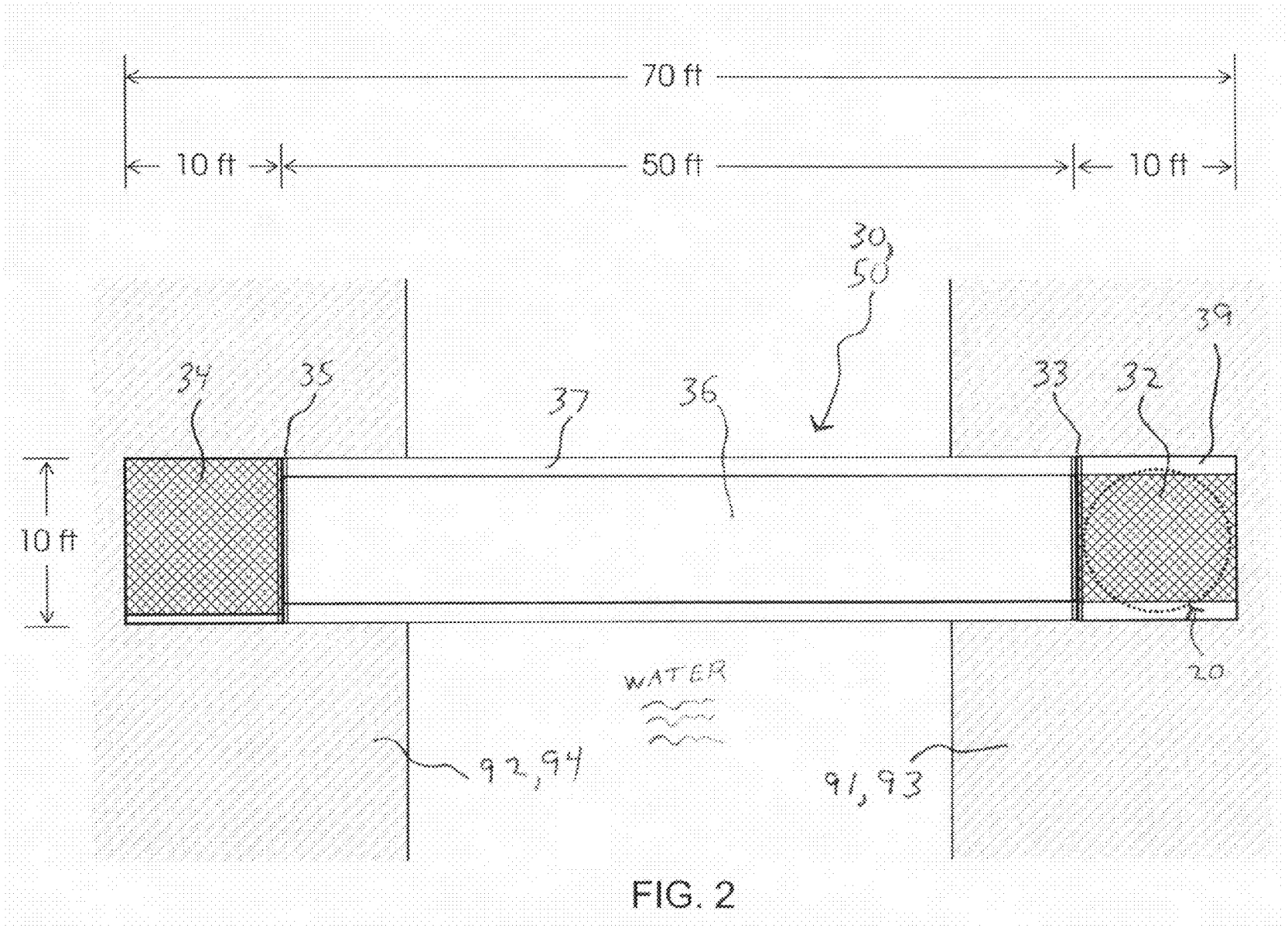
FIG. 2 is a top plan view of the inventive ramp system embodiment shown in FIG. 1.
Figure 3:
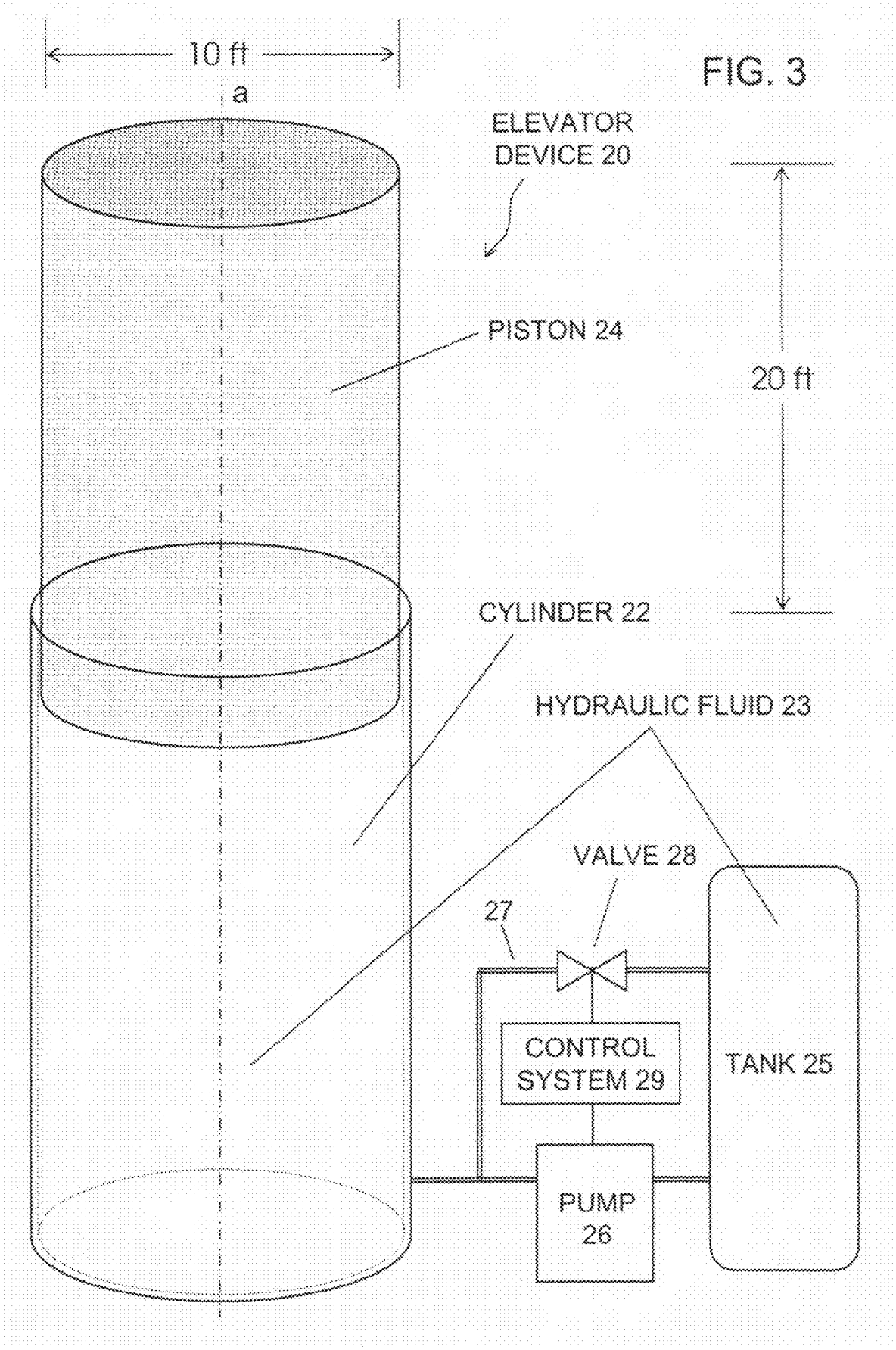
FIG. 3 is a diagrammatic representation and perspective view of an embodiment of a hydraulic elevator device such as in included in the inventive ramp system embodiment shown in FIG. 1 and FIG. 2.
Figure 4:
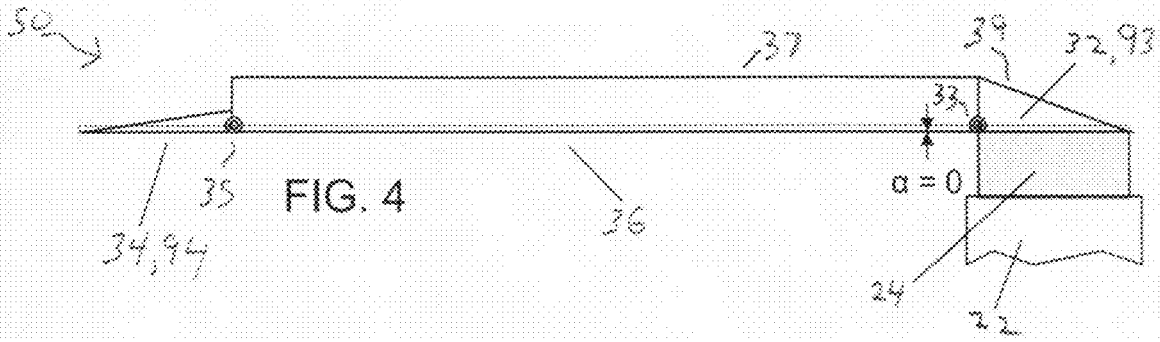
FIG. 4 through FIG. 7 are side elevation views (with the hydraulic elevator partially shown) of the inventive ramp system embodiment shown in FIG. 1 and FIG. 2, wherein each of FIG. 4 through FIG. 7 shows a different angle of vertical inclination, downward from the host ship, of the inventive ramp system's ramp.
Figure 5:
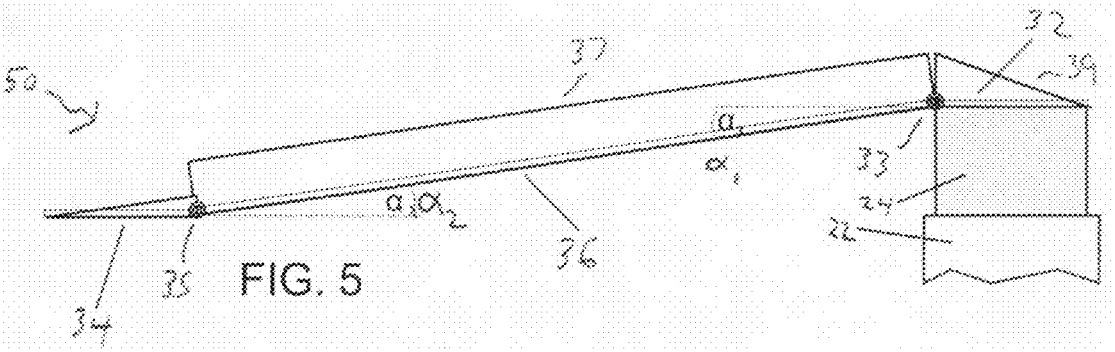
Figure 6:
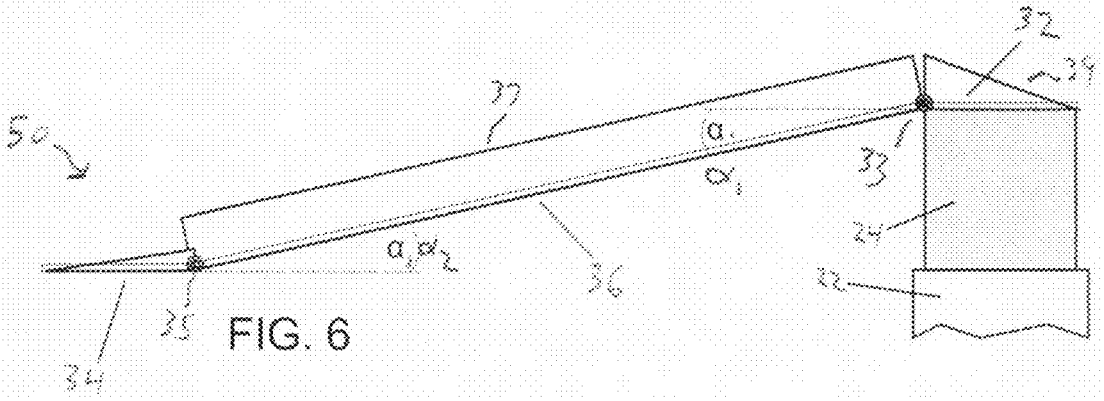
Figure 7:
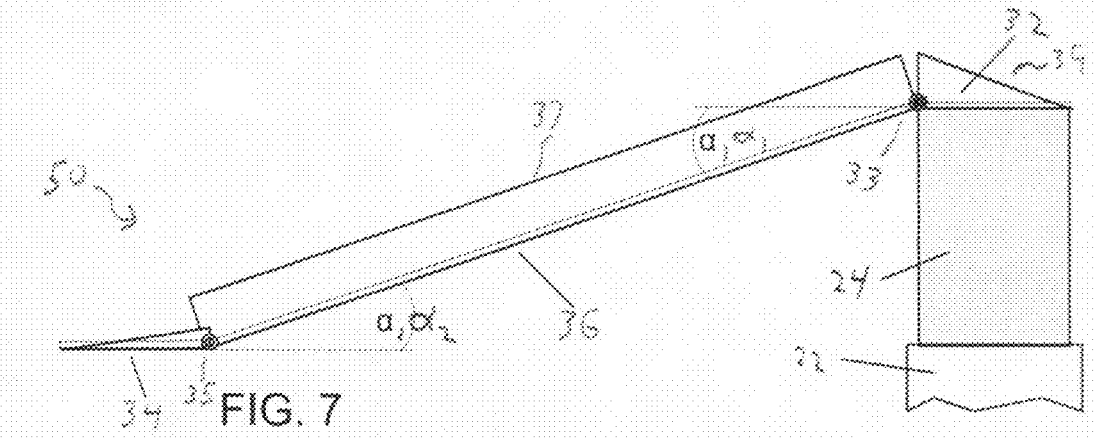

Referring now to FIG. 1, FIG. 2 and FIG. 3, the present invention's bridging ramp system 50 includes hydraulic elevator device 20 and ramp apparatus 30. Hydraulic elevator device 20 includes a hollow cylinder 22 and a piston cylinder 24.

As shown in FIG. 3, hollow cylinder 22 and solid piston cylinder 24 share geometric longitudinal axis a. Solid piston cylinder 24 has a flat horizontal upper end surface 25. Piston cylinder 24 snugly, but slidably, fits inside hollow cylinder 22. Piston cylinder 24 is attributed with both translatability and rotatability; that is, piston cylinder 24 is bidirectionally rotatable (pivotable) about and bidirectionally translatable (linearly movable) along axis a. Elevator device 20 can be hydraulically activated so as to selectively and fixedly position piston cylinder 24 along axis a in accordance with an amount of incompressible fluid 23 in hollow cylinder 22.

Piston cylinder 24 is attached inside hollow cylinder 22 and is driven by hydraulic fluid 23. Tank 25 is a reservoir for hydraulic fluid 23. Control system 29 sends signals to pump 26 and valve 28. Pump 26 (powered, e.g., by an electric motor) forces hydraulic fluid 23 from tank 25 into a conduit 27 that connects to hollow cylinder 22. When valve 28 (e.g., a solenoid valve) is opened, the pressurized hydraulic fluid 23 is conducted back to tank 25; however, when valve 28 is closed, the pressurized hydraulic fluid 23 is conducted to (via conduit 27) and into hollow cylinder 22. The increase in amount of hydraulic fluid 23 in hollow cylinder 22 is accompanied by raising of piston cylinder 24, since the hydraulic fluid 23 pushes up piston cylinder 24. When piston cylinder 24 reaches the desired height, control system 29 causes the pump to turn off; since the fluid 23 occupying hollow cylinder 22 remains but no more fluid 23 enters, piston cylinder 22 remains in place, resting upon fluid 23. When valve 28 is opened, the fluid 23 occupying hollow cylinder 22 flows out of hollow cylinder 22 and is conducted (via conduit 27) to tank 25.

As shown in FIG. 1 and FIG. 2, ramp apparatus 30 includes a horizontal planar host-end platform 32, a planar guest-end platform 34, a planar ramp 36, a horizontal host-end hinge mechanism 33, a horizontal guest-end hinge mechanism 35, a pair of ramp safety side-rails 37, and a pair of platform safety side-rails 39. The present invention's ramp apparatus 30 is frequently embodied so that the three major components of ramp apparatus 30 are each rectangular, are of equal width, and are connected end-to-end to form a continuous ramp unit having an overall rectangular profile having that uniform width. The dimensions indicated in FIG. 2 correspond to an inventive embodiment being considered for Navy use. Congruity of the end platforms frequently characterizes inventive practice; note, for instance, that platforms 32 and 34 are shown to both be square, each having length and width of 10 feet. The embodiment contemplated by the Navy is suitable for walking across and is particularly suitable for driving HUMVEE® motor vehicles across from the host ship 91 to the guest ship 92.

Host-end platform 32 is attached to piston cylinder 24 whereby the flat horizontal bottom surface of host-end platform 32 is adjacent to the flat horizontal upper surface 25 of piston cylinder 24; that is, host-end platform 32 securely sits, surface-to-surface, on top of piston cylinder 24. In furtherance of the structural integrity of the inventive ramp system 50, frequent inventive practice provides for dimensional compatibility between host-end platform 32 and piston cylinder 24, for instance so that host-end platform 32 has a length and width that equals or nearly equals the diameter of piston cylinder 24. Elevator device 20 is designed so that the upper surface 25 of piston cylinder 24 is at all times at least even with, and preferably at all times at least slightly above, the top rim of hollow cylinder 22. In other words, piston cylinder 24 should always project to some degree out of hollow cylinder 22 in order that the attachment of host-end platform 32 to piston cylinder 24 not be compromised. Ramp 36, the main ramp body of ramp apparatus 30, is intermediate host-end platform 32 and guest-end platform 34. Host-end hinge mechanism 33 vertically-pivotably joins host-end platform 32 and ramp 36. Guest-end hinge mechanism 35 vertically-pivotably joins guest-end platform 34 and ramp 36. Hinge mechanisms 33 and 35 each include not only hinge-related components but also any attachment/reinforcement components (e.g., bolts) that may be suitable for ensuring the trueness of the joint.

Inventive ramp system 50 can be designed to accommodate pedestrian and/or vehicular traffic. According to typical inventive operation in a marine context, hollow cylinder 22 (containing piston cylinder 24) is mounted at its bottom upon a deck of a host ship 91. Piston cylinder 24 is hydraulically caused to be raised or lowered in order that the top surface of host-end platform 32 is even with a different (higher or lower) deck of host ship 91, such as access deck 93 shown in FIG. 2. Ramp apparatus 30 is extended and oriented (e.g., using a crane) so as to place guest-end platform 34 at the desired location (according to typical inventive practice, a flat surface) of the guest ship 92, such as resting upon destination deck 94. Pedestrian and/or vehicular traffic can walk or drive (or otherwise travel, e.g., using a bicycle or other un-motorized wheeling capability) from access deck 93 onto host-end platform 32, across ramp 36, onto guest end-platform 34, and onto destination deck 94. The two ramp safety side-rails 37 (on opposite longitudinal sides of ramp 36) and the two platform safety side-rails 39 (on opposite longitudinal sides of host-end platform 32) serve to protect the entities crossing from falling off ramp apparatus 30 and plunging into the sea below.

AM General Corporation manufactures the "High Mobility Multipurpose Wheeled Vehicle" (abbreviated "HMMWV"), which is popularly referred to as HUMVEE®. The HUMVEE® is a highly mobile four-wheel-drive U.S. military vehicle that provides a common light tactical vehicle capability. The HUMVEE® can be configured in a variety of vehicular modes, e.g., troop carrier, armament carrier, ambulance, scout vehicle, etc. An inventive bridging ramp system embodiment contemplated for Navy transfer of HUMVEEs® and pedestrians between ships at sea includes a ramp 50 feet in length, a host-end platform 10 feet in length, a guest-end platform 10 feet in length, and a piston cylinder 10 feet in diameter; the ramp apparatus is thus 70 feet in length. This inventive embodiment under consideration by the Navy can accommodate a difference between the respective platform heights of the host and guest ships of up to 20 feet. Since the Navy's proposed inventive ramp system 50 embodiment is primarily designed for only one basic vehicle type, the design need not be especially complex.

Still referring to FIG. 1 through FIG. 3 and also referring to FIG. 4 through FIG. 10, inventive ramp system 50 is imbued with great flexibility with respect to extension and orientation, in order to situate guest-end platform at a selected location. Firstly, the height of host-end platform 32 can be adjusted by moving piston cylinder 24, upward or downward, along vertical axis a. Secondly, the horizontal angle $\beta$ of ramp apparatus 30, relative to perpendicular vertical geometric plane p (which generally represents the perpendicular distance between host ship 91 and guest ship 92), can be adjusted by pivoting piston cylinder, clockwise or counterclockwise, about axis a. Thirdly, the vertical angle $\alpha_1$ of ramp 36, relative to host-end platform 32, can be adjusted via pivoting of host-end hinge mechanism 33. Fourthly, the vertical angle $\alpha_2$ of ramp 36, relative to guest-end platform 34, can be adjusted via pivoting of guest-end hinge mechanism 35.

Ramp apparatus 30 is hinged in two places. Host-end hinge mechanism 33 connects ramp 36 and host-end platform 32, and is just outboard (with respect to host ship 91) of where host-end platform 32 sits on the lifting piston cylinder 24. Host-end hinge mechanism 33 connects ramp 36 and host-end platform 32, and is just outboard (with respect to guest ship 92) of where guest-end platform 34 sits on destination deck 94 of guest ship 92. Hinge mechanisms 32 and 34 impart flexibility to ramp apparatus 30 such that ramp apparatus 30 can conform to practically any angle naturally develops between the two ships 91 and 92, doing so so as not to disturb the horizontal disposition of host-end platform 32 atop piston cylinder 24 and so as to permit the horizontal disposition of guest-end platform 34 atop destination deck 94.

Figure 8:
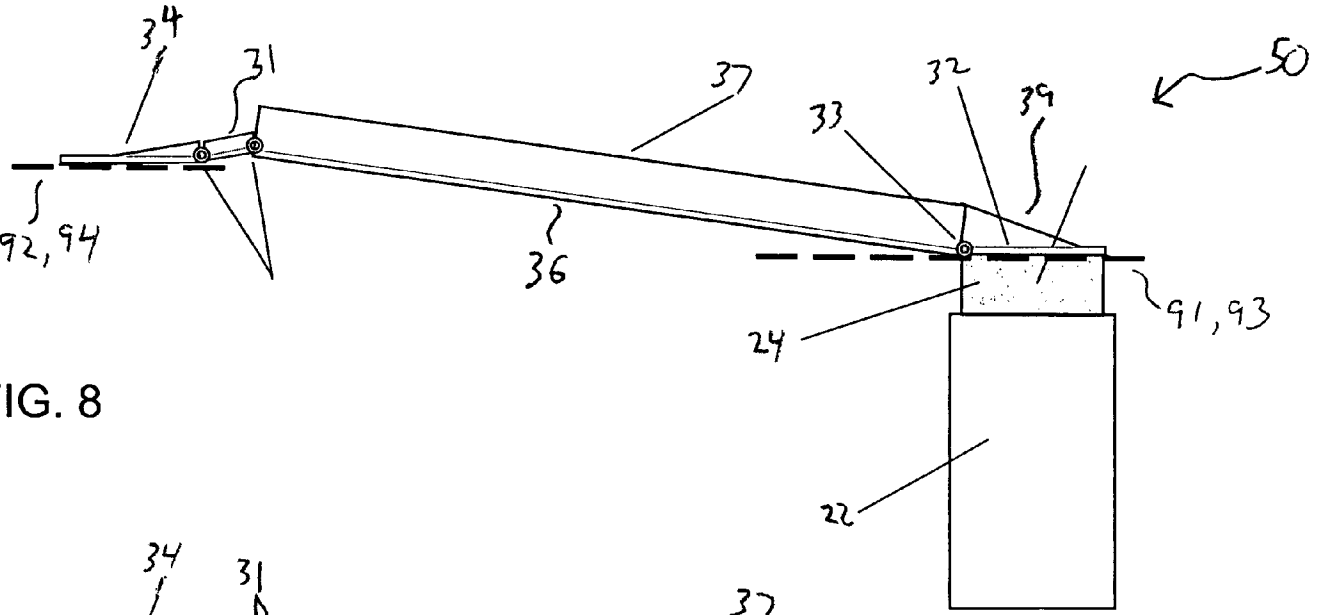
FIG. 8 and FIG. 9 are side elevation views of another embodiment of a bridging ramp system in accordance with the present invention, wherein the inventive ramp system is capable of practice in which the angle of vertical inclination of the ramp is upward from the host ship.
Figure 9:
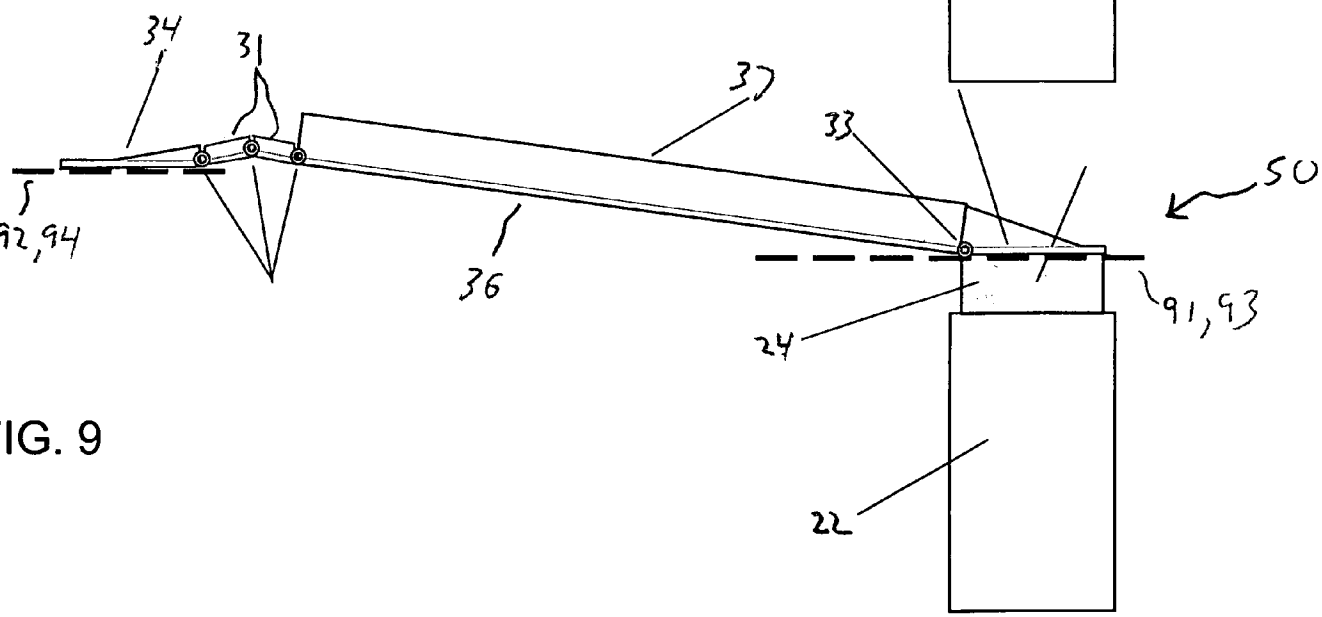

Typical inventive practice involves horizontality of both host-end platform 32 and guest-end platform 34, such as depicted in FIG. 4 through FIG. 9; hence, under these typical circumstances, vertical angle $\alpha_1$ equals vertical angle $\alpha_2$, so both vertical angles can be denoted simply as the same vertical angle $\alpha$. FIG. 4 through FIG. 7 illustrate more typical inventive practice, wherein ramp 36 is inclined downward from host-end platform 32. Here the vertical angle of inclination $\alpha_1$ (the vertical angle with respect to the horizontal geometric plane defined by host-end platform 32) is either zero (i.e., wherein host-end platform 32 and ramp 36 are both horizontal) or some downward acute angle. Generally speaking, especially from a safety standpoint, the present invention should be practiced so that the downward vertical angle $\alpha_1$ does not exceed twenty degrees. FIG. 8 and FIG. 9 illustrate less typical inventive practice, wherein ramp 36 is inclined upward from host-end platform 32. Here the vertical angle of inclination $\alpha_1$ is either zero or some upward acute angle (which, particularly for safety reasons, will generally not exceed twenty degrees).

The inventive embodiments that provide for downward vertical angles $\alpha_1$ will not necessarily additionally provide for upward vertical angles $\alpha_1$. In cases of upward vertical angles $\alpha_1$, the guest-end hinge mechanism 35 required for practicing downward vertical angles $\alpha_2$ (i.e., the downward vertical angle with respect to the horizontal geometric plane defined by guest-end platform 32) will generally be more complex/sophisticated, such as involving two hinges (FIG. 8) or three hinges (FIG. 9) with ramp/platform sections 31 therebetween. In contrast, in cases of downward vertical angles $\alpha_1$, the guest-end hinge mechanism 35 required for practicing upward vertical angles $\alpha_2$ (i.e., the upward vertical angle with respect to the horizontal geometric plane defined by guest-end platform 32) will generally be less complex/sophisticated, such as involving the single hinge shown in FIG. 4 through FIG. 7.

Figure 10:
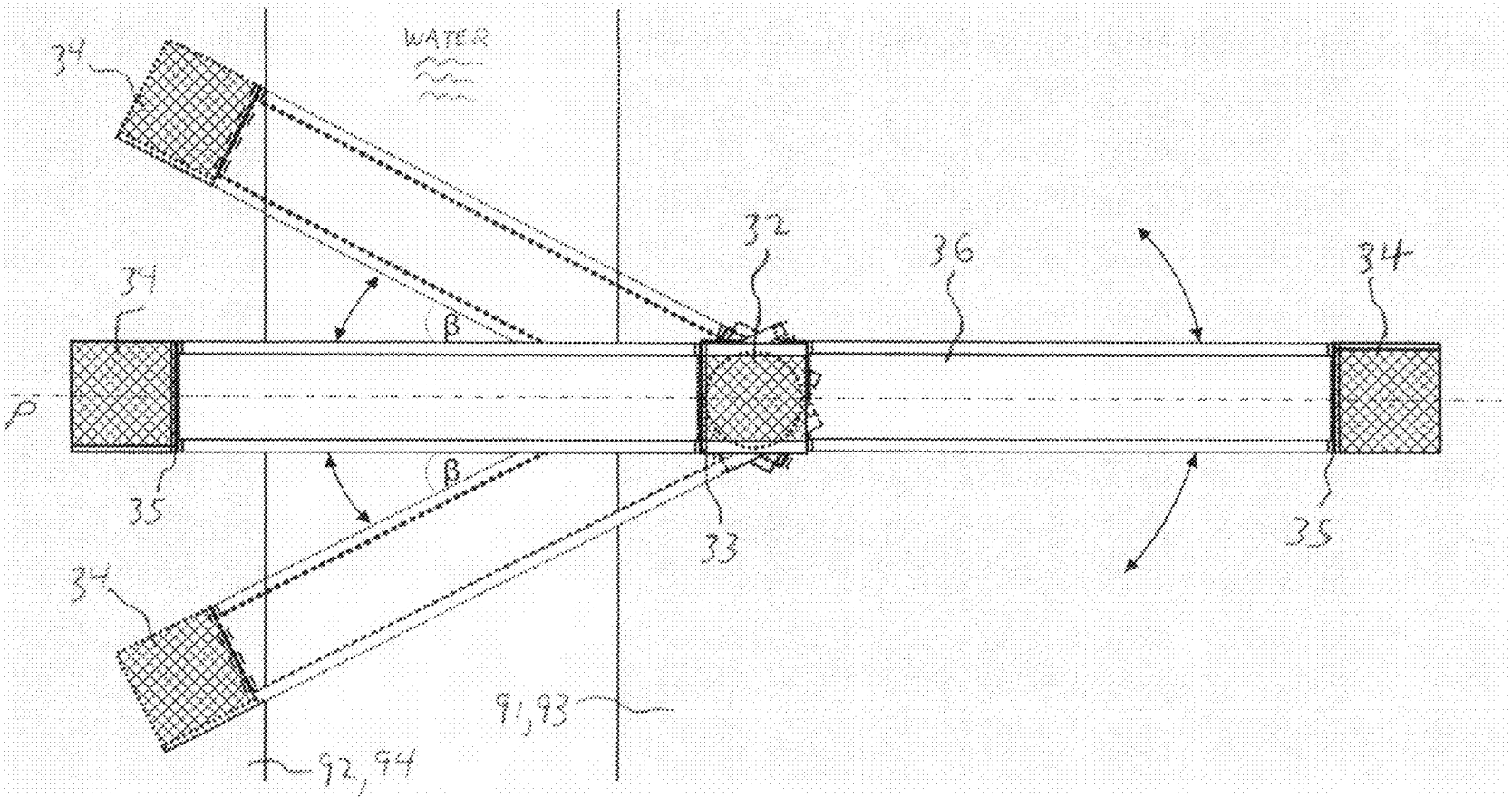
FIG. 10 is a top plan view of the inventive ramp system embodiment shown in FIG. 1 and FIG. 2, particularly illustrating rotatability of the ramp apparatus via the piston cylinder.

FIG. 10 illustrates inventive practice wherein the horizontal angle β (i.e., the angle with respect to the geometric vertical plane that coincides with the perpendicular distance between the essentially parallel sides of host ship 91 and guest ship 92) can be adjusted by the inventive practitioner from perpendicularity to acute angles in either lateral direction. This horizontal rotational capability is especially useful when the host ship 91 and guest ship 92 are moored together such that the desired footing location for guest-end platform 34 is off at a horizontal angle with respect to host-end platform 32. Horizontal rotational adjustment is performed in either direction by horizontally pivoting piston cylinder 24. Generally speaking, from a safety standpoint in particular, the present invention should be practiced so that the horizontal angle β, either left or right, does not exceed thirty degrees.

Still referring to FIG. 10, stowage of ramp apparatus can be accomplished by horizontally rotating ramp apparatus, via active (hydraulic) horizontal rotation of piston cylinder about its vertical longitudinal axis, from the outboard (operating position) to the inboard (stowed) position; for instance, ramp apparatus is rotated one hundred eighty degrees from the perpendicular outboard position to the perpendicular inboard position. Further, ramp apparatus can stowed at a selected level (e.g., from among different levels) by raising and lowering the height of ramp apparatus. For instance, ramp apparatus can be stowed on top of the hangar, with piston cylinder in the uppermost position.

Figure 11:
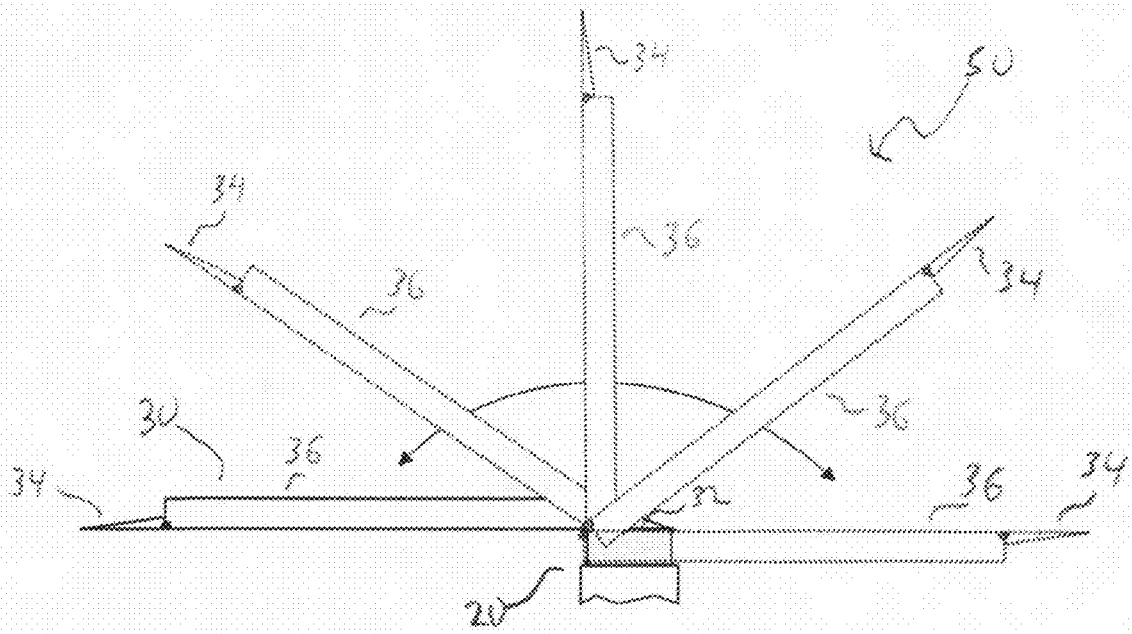
FIG. 11 is a side elevation view of another embodiment of a bridging ramp system in accordance with the present invention, wherein the ramp apparatus is capable of being rotated backward to an inverted position for stowage.

With reference to FIG. 11, as a less frequently practiced alternative to rotation, for inventive purposes of bring ramp apparatus from operation mode to stowage mode, the ramp and guest-end platform sections of ramp apparatus can be folded over (e.g., vertically rotated approximately one hundred eighty degrees) via host-end hinge mechanism so that a portion of ramp sits upon host-end platform; however, this fold-over approach to stowability would generally require a more sophisticated host-end hinge mechanism than would normally be required according to inventive practice. Some inventive embodiments feature foldability of the guest-end platform over/under the ramp. The rotation of ramp apparatus from its inboard (stowage) position to its outboard (operation) position can be effected either through active (hydraulic) horizontal rotation or passive horizontal rotation of the piston cylinder about its vertical longitudinal axis; according to passive rotation, piston cylinder is allowed to freely rotate while a crane moves ramp apparatus into position.

Generally speaking, a seagoing ship is characterized by motion describable in terms of six degrees of freedom, viz., heave, surge, sway, roll, pitch, and yaw. The term "six degrees of freedom" is conventionally used to describe both translational motion and rotational motion of a body with respect to three perpendicular axes in three-dimensional space. Regarding motion of ships, the three kinds of translational ship motion are commonly referred to as heave (linear movement along a vertical axis), surge (linear movement along a horizontal fore-and-aft axis), and sway (linear movement along a horizontal port-and-starboard axis); the three kinds of rotational ship motion are commonly referred to as roll (rotational movement about a horizontal fore-and-aft axis), pitch (rotational movement about a horizontal port-and-starboard axis), and yaw (rotational movement about a vertical axis).

Practice of the inventive adjustable height bridging ramp system typically involves the side-by-side mooring (e.g., tying together using ropes) of two ships in an approximately longitudinally-parallel fashion, and the deployment of the inventive system's ramp apparatus (based on the host ship) in a generally transverse direction (approximately perpendicular to the ships, with a typical leeway of approximately)±30° from the host ship (upon which the inventive system is based, e.g., wherein the hydraulic elevator device's hollow cylinder is mounted on a deck of the host ship and the inventive ramp apparatus's host-end platform is mounted atop the elevator device's piston cylinder) to the guest ship (with respect to which the inventive system is deployed, e.g., wherein the inventive ramp apparatus's guest-end platform is abuttingly placed upon a deck of the guest ship). The side-by-side mooring of the host and guest ships, typically involving the tying together of the two ships and generally designed to constrain relative movement, practically eliminates (or at least substantially attenuates) the relative generally horizontal motion between the two ships in terms of sway and roll of each ship. The inventive vertical damper system (typically including one or more inventive vertical damper devices), described in a concurrently filed application, practically eliminates (or at least substantially attenuates) the relative generally vertical motion between the two ships in terms of heave and yaw of each ship.

The inventive vertical damping system, emphasized in the afore-noted concurrently filed application, is typically practiced in association with a plurality of marine vessels, and can be variously embodied to include one or more vertical damping devices. Notably, the inventive vertical damping system diminishes the relative vertical movement between two or more water vessels that are moored in a skin-to-skin orientation. Each inventive vertical damping device (which is included in an inventive vertical damping system) is pivotally connected to a side portion of a first vessel, and is detachably connected to a side portion of a second vessel. The inventive vertical damping device may describe a piston/cylinder arrangement, and the inventive vertical damping system may involve more than two marine vessels. The inventive vertical damping system counteracts the effect of vertical motion (e.g., roll motion) on marine vessels, thereby enabling ship-to-ship operations such as cargo loading and the like.

Accordingly, what the inventive bridging ramp system is primarily left to contend with are the forces associated with surge and pitch of each ship. The relative motion between the two ships may describe cyclical movement of the two ship hulls, closer and farther apart. Inventive practice typically involves adjustment of the height and the horizontal and vertical angles of the inventive ramp system's ramp apparatus so as to finally be established in its fully useful deployment configuration, whereby the guest-end platform situated upon a guest ship surface, which is typically flat and horizontal. Due to the generally horizontal relative motion between the two ships in terms of surge and pitch, some sliding of the guest-end platform will typically occur, at least at times and perhaps frequently or continually (depending on sea state), once the inventive ramp apparatus is established in its final deployment configuration. According to usual inventive practice, the basic components of the inventive ramp system (i.e., host-end platform, ramp, guest-end platform, host-end hinge mechanism, guest-end hinge mechanism, hollow cylinder, piston cylinder) are composed or substantially composed of a strong structural material, such as a structural steel or other suitable metal or metal alloy material.

Figure 12:
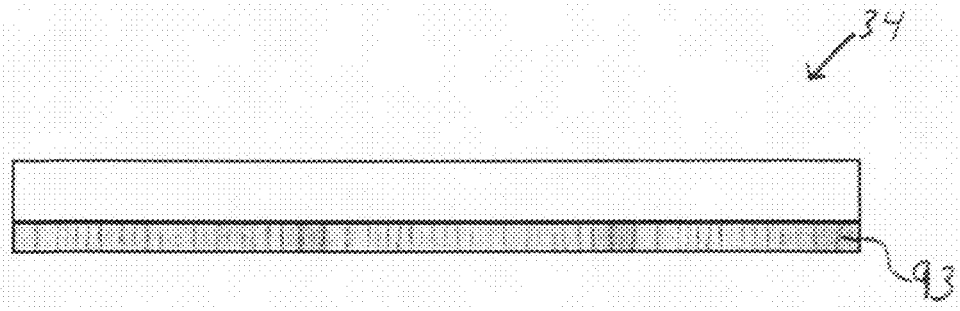
FIG. 12 and FIG. 13 are side elevation views of embodiments of a guest-end platform component of an inventive ramp system such as shown in FIG. 1 and FIG. 2, wherein guest-end platform component includes a continuous bottom layer of wood or other sacrificial material (FIG. 12), or a discontinuous bottom layer of wood or other sacrificial material (FIG. 13), or rolling means including a set of wheels (FIG. 13).
Figure 13:
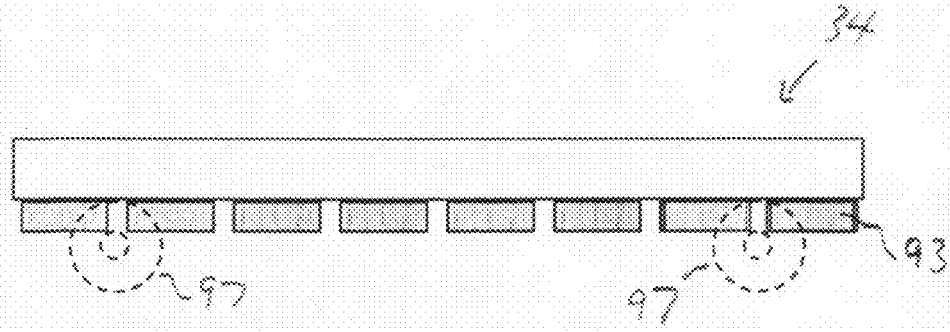

With reference to FIG. 12 and FIG. 13, inventive practice will normally provide for a bottom layer of sacrificial material (such as wood), attached beneath the main structure (typically made of metal or metal alloy) of the guest-end platform. The sacrificial material layer 93, typically coextensive with the main (structural) portion of the guest-end platform, serves a direct sliding contact function in association with the deck (typically made of metal or metal alloy) of the guest ship. The sacrificial material layer should be characterized by a sufficient degree of friction (especially when contacting a ship deck, typically made of steel) to maintain a footing of the guest-end platform upon the guest ship's deck surface, but should also be characterized by a sufficient degree of skid capability so that the guest-end platform can appropriately slide moderate distances upon the guest ship's deck surface because of the relative ship motion associated with surge and pitch of each ship. The sacrificial material layer 93 can be continuous (such as the wood plank shown in FIG. 12) or discrete (such as the wood slats shown in FIG. 13). As an alternative to attachment of a sacrificial layer underneath the guest platform's metal structure, wheel means (such as including wheels 97 diagrammatically illustrated in FIG. 13) can be provided.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications and changes to the principles disclosed herein may be made by one skilled in the art without departing from the true scope and spirit of the present invention, which is indicated by the following claims.

What is claimed is:

1. A bridging ramp system for use in association with a host ship and a guest ship, the bridging ramp system comprising a hydraulic elevator device, a controller, and a ramp apparatus;

the hydraulic elevator device being for situation onboard said host ship, said hydraulic elevator device including a hollow cylinder and a piston cylinder, said hollow cylinder and said piston cylinder sharing an approximately vertical geometric longitudinal axis, said piston cylinder having a flat approximately horizontal piston cylinder top surface and nonsecurely fitting in said hollow cylinder to permit approximately three-hundred-sixty-degree bidirectional rotatability of said piston cylinder about said axis and approximately vertical bidirectional movability of said piston cylinder along said axis, said hollow cylinder having a hollow cylinder uppermost region;

said piston cylinder being positionable by said controller along said axis in accordance with an amount of incompressible fluid within said hollow cylinder, said controller being capable of controlling the movability of said piston cylinder along said axis so as to adjust the axial height of said piston cylinder top surface between a maximum said axial height and a minimum said axial height that is at least slightly higher axially than said hollow cylinder uppermost region, said controller being further capable of controlling the rotatability of said piston cylinder about said axis so as to adjust the angle of said ramp to any orientation in an approximately horizontal geometric plane;

said ramp apparatus including a planar host-end platform, a planar guest-end platform, a generally planar ramp, a host-end hinge mechanism, and a guest-end hinge mechanism, said host-end platform having a generally flat host-end platform top surface and a generally flat host-end platform bottom surface, said ramp having a generally flat ramp top surface and a generally flat ramp bottom surface, said guest-end platform having a generally flat guest-end platform top surface and a generally flat guest-end platform bottom surface, said host-end platform being fixed atop said piston cylinder so that said host-end platform bottom surface is adjacently attached to said piston cylinder top surface, the fixed said host-end platform top surface being approximately horizontal;

said ramp connectively being intermediate said host-end platform and said guest-end platform so that said ramp apparatus is approximately symmetrical with respect to an approximately vertical geometric plane that longitudinally approximately bisects said ramp apparatus, said host-end hinge mechanism pivotably joining said host-end platform and said ramp so that the angle of said ramp freely adjusts with respect to said host-end platform in said approximately vertical geometric plane, said guest-end hinge mechanism pivotably joining said guest-end platform and said ramp so that the angle of said ramp freely adjusts with respect to said host-end platform in said approximately vertical geometric plane;

wherein according to operation mode of the bridging ramp system said ramp apparatus is extended outboard of said host ship, said ramp top surface and said guest-end platform top surface facing generally upward to permit transit between said host ship and said guest ship, said guest-end platform being placeable onboard said guest ship so that said guest-end platform bottom surface sits upon a selected area of said guest ship, said guest-end platform bottom surface permitting sliding of said guest-end platform with respect to said selected area of said guest ship so that said ramp apparatus is capable of remaining essentially in place while accommodating generally horizontal relative motion between said host ship and said guest ship;

wherein according to a first stowage mode of the bridging ramp system said ramp apparatus is extended inboard of said host ship via said rotatability of said piston cylinder about said axis, and wherein according to a second stowage mode of the bridging ramp system said ramp apparatus is extended inboard of said host ship via said pivotability of said host-end hinge mechanism in said approximately vertical geometric plane, said ramp being pivotably adjustable in an at least approximately two-hundred degree range in said approximately vertical geometric plane between at least approximately twenty degrees downward from horizontality for said operation mode to approximate horizontality for said second stowage mode.

2. The bridging ramp system of claim 1, wherein said ramp apparatus according to said second stowage mode is capable of being configured so that said ramp is pivotably adjusted approximately completely backward so as to rest in an approximately horizontal disposition upon said host-end platform top surface, said ramp bottom surface and said guest-end platform bottom surface facing generally upward.

3. The bridging ramp system of claim 1, wherein said second guest-end platform bottom surface includes an exterior material having a frictional and sacrificial character that furthers adaptation to said relative motion so as to maintain stability of said ramp apparatus during said operation mode.

4. The bridging ramp system of claim 1, wherein said controller is capable of controlling the pivotability of said host-end hinge mechanism so as to adjust the pivoting of said ramp in said approximately vertical geometric plane.

5. A ramp system for bridging between two marine vessels; said ramp system comprising a hydraulic elevator device and a ramp unit; said hydraulic elevator device including a cylinder and a piston; said cylinder and said piston having a common geometric longitudinal axis; said piston being bidirectionally movable via electronic control both linearly along said axis and rotatably about said axis; said cylinder being mounted, with said axis vertical, on a first marine vessel; said ramp unit including a first extreme planar member, a second extreme planar member, and a medial planar member; said piston having a horizontal top piston surface; said first extreme planar member being contiguously mounted on said piston atop said horizontal top piston surface so that said first extreme planar member is horizontal; said piston being bidirectionally movable linearly along said axis so that said first extreme plane member varies between an upper vertical height and a lower vertical height; said top piston surface being at least slightly above said cylinder when said first extreme plane member has said lower vertical height; said piston being rotatably movable three hundred sixty degrees about said axis so that said ramp unit is capable of describing any horizontal geometric angle, inboard or outboard, with respect to said first marine vessel; said medial planar member and said first extreme planar member being joined pivotably about a first edgewise junction; said medial planar member and said second extreme planar member being joined pivotably about a second edgewise junction; said medial planar member being pivotable about said first edgewise junction so that said vertical geometric angle formed at said first edgewise junction by said medial planar member and said first extreme planar member ranges between a downwardly slanted position of said medial planar member forward of said first extreme planar member and an inverted horizontal position of said medial planar member parallel to and aft of said first extreme planar member; said second extreme planar member being positionable on a second marine vessel so as to enable passage between said first marine vessel and said second marine vessel; said medial planar member being pivotable about said second edgewise junction so that said vertical geometric angle formed at said second edgewise junction by said medial planar member and said second extreme planar member adapts to said positioning of said second extreme planar member on said second marine vessel; said second extreme planar member having a bottom surface that is suitable, in terms of friction and wear, for slidably contacting said second marine vessel when said first marine vessel and said second marine vessel are in horizontal motion relative to each other; said ramp system being configurable either enabling said passage between said first marine vessel and said second marine vessel, or for effecting stowage of said ramp system on said first marine vessel; said configurability of said ramp system including variability of said vertical height of said first extreme planar member, said horizontal geometric angle described by said ramp unit with respect to said first marine vessel, said vertical geometric angle formed at said first edgewise junction by said medial planar member and said first extreme planar member, and said vertical geometric angle formed at said second edgewise junction by said medial planar member and said second extreme planar member.

6. The ramp system for bridging between two marine vessels as recited in claim 5, wherein said configurability of said ramp system further includes variability of the location of said mounting of said cylinder on said first marine vessel.

7. The ramp system for bridging between two marine vessels as recited in claim 5, wherein said first extreme planar member, said second extreme planar member, and said medial planar member:

are each rectangular;

each have the same width; and are joined at respective ends so that said ramping unit has a uniform said width.

8. The ramp system for bridging between two marine vessels as recited in claim 7, wherein said first extreme planar member and said second extreme planar member each have the same extreme planar member length, and wherein said medial planar member has a medial planar member length that is greater than said extreme planar member length.

9. The ramp system for bridging between two marine vessels as recited in claim 5, wherein said second extreme planar member is positionable on a horizontal deck surface of said second marine vessel.

10. The ramp system for bridging between two marine vessels as recited in claim 9, wherein when said first marine vessel and said second marine vessel are in horizontal motion relative to each other:

said positioning of said second extreme planar member on said horizontal deck surface is characterized by a degree of slippage of said second extreme planar member on said horizontal deck surface;

said slippage is accommodative of the relative said horizontal motion so that said configuration of said ramp system is maintainable in the presence of the relative said motion.

11. The ramp system for bridging between two marine vessels as recited in claim 10, wherein said bottom surface of said second extreme planar member includes a bottom surface material that is characterized by a suitable degree of friction, with respect to said horizontal deck surface, for preventing excessive said slippage.

12. The ramp system for bridging between two marine vessels as recited in claim 9, wherein:

said ramp unit further includes rolling means for said second extreme planar member, said rolling means including plural wheels;

when said first marine vessel and said second marine vessel are in horizontal motion relative to each other, said rolling means attributes said second extreme planar member with responsiveness to the relative said horizontal motion so that said configuration is sustainable in the presence of the relative said horizontal motion.

* * * * *